US007004153B2

(12) United States Patent
Lisseveld

(10) Patent No.: US 7,004,153 B2
(45) Date of Patent: Feb. 28, 2006

(54) FUEL TREATMENT DEVICE USING A MAGNETIC FIELD

(76) Inventor: Wout Lisseveld, 1661 Estero Blvd. #18, Ft. Myers Beach, FL (US) 33932

( * ) Notice: Subject to any disclaimer, the term of this patent is extended or adjusted under 35 U.S.C. 154(b) by 144 days.

(21) Appl. No.: 10/462,026

(22) Filed: Jun. 13, 2003

(65) Prior Publication Data

US 2004/0250799 A1 Dec. 16, 2004

(51) Int. Cl.
*F02B 75/10* (2006.01)

(52) U.S. Cl. ..... 123/538

(58) Field of Classification Search ..... 123/536–638; 210/222, 695; 431/356
See application file for complete search history.

(56) References Cited

U.S. PATENT DOCUMENTS

| | | | | |
|---|---|---|---|---|
| 3,586,015 | A | 6/1971 | Kitzner et al. | |
| 4,210,535 | A | 7/1980 | Risk | |
| 4,334,889 | A * | 6/1982 | Takabayashi | 44/457 |
| 4,407,719 | A | 10/1983 | Van Gorp | |
| 4,414,951 | A * | 11/1983 | Saneto | 123/538 |
| 4,422,933 | A | 12/1983 | Sverre et al. | |
| 4,422,935 | A | 12/1983 | Mattingly | |
| 4,430,785 | A | 2/1984 | Sanderson | |
| 4,460,516 | A | 7/1984 | Kapitanov et al. | |
| 4,568,901 | A | 2/1986 | Adam | |
| 4,572,145 | A | 2/1986 | Mitchell et al. | |
| 4,662,314 | A | 5/1987 | Moore, Jr. | |
| 4,888,113 | A | 12/1989 | Holcomb | |
| 4,946,590 | A | 8/1990 | Hertzog | |
| 4,950,317 | A | 8/1990 | Dottermans | |
| 5,005,189 | A | 4/1991 | Hackett, Jr. | |
| 5,009,791 | A | 4/1991 | Lin et al. | |
| D319,287 | S | 8/1991 | Baumstark et al. | |
| 5,124,045 | A | 6/1992 | Janczak et al. | |
| 5,127,385 | A * | 7/1992 | Dalupin | 123/538 |
| 5,161,512 | A | 11/1992 | Adam et al. | |
| 5,166,620 | A | 11/1992 | Panosh | |
| 5,171,487 | A | 12/1992 | Hudz | |
| 5,174,892 | A | 12/1992 | Davis | |
| 5,178,757 | A | 1/1993 | Corney | |
| 5,190,018 | A | 3/1993 | Costello et al. | |
| 5,194,413 | A | 3/1993 | Kumar | |
| 5,221,471 | A | 6/1993 | Huntley | |
| 5,238,558 | A | 8/1993 | Curtis | |
| 5,239,911 | A | 8/1993 | Ostor | |
| 5,243,946 | A | 9/1993 | Dalupan | |
| 5,249,552 | A | 10/1993 | Brooks | |
| 5,254,247 | A | 10/1993 | Kashani | |
| 5,271,369 | A * | 12/1993 | Melendrez | 123/538 |
| 5,271,639 | A | 12/1993 | Nishizawa | |
| 5,271,834 | A | 12/1993 | Mondiny | |
| 5,288,401 | A | 2/1994 | Rodriguez | |
| 5,296,141 | A | 3/1994 | Ellison | |
| 5,304,299 | A | 4/1994 | Kumar | |

(Continued)

FOREIGN PATENT DOCUMENTS

WO WO 2004031566 A1 4/2004

*Primary Examiner*—Marguerite McMahon
(74) *Attorney, Agent, or Firm*—Hahn Loeser & Parks, LLP; Robert J. Clark

(57) ABSTRACT

Magnetic fuel treatment devices are disclosed, the devices comprising, in part, a housing, cover, inner compartment, and magnet, the combination of which forming an inner fuel channel through which fuel may flow for treatment therein. Certain aspects of the invention include designs that concentrate fuel flow within magnetic flux densities ranging from about 600 to about 1,200 Gauss.

21 Claims, 4 Drawing Sheets

U.S. PATENT DOCUMENTS 5,331,807 A * 7/1994 Hricak ..... 60/275
5,348,050 A 9/1994 Ashton
5,359,979 A * 11/1994 Anfinson et al. ..... 123/538
5,364,536 A 11/1994 Mercier
5,366,623 A 11/1994 Clair
5,368,748 A 11/1994 Sanderson
D353,438 S 12/1994 Yuksel
5,380,430 A 1/1995 Overton et al.
5,411,143 A 5/1995 Greene
5,454,998 A 10/1995 Bogatin et al.
5,460,144 A 10/1995 Park et al.
5,603,368 A 2/1997 Colson et al.
5,637,226 A 6/1997 Adam et al.
5,716,520 A 2/1998 Mason
RE35,826 E 6/1998 Spiegel
5,918,636 A 7/1999 Mitchell et al.
6,000,382 A 12/1999 Albisetti
D420,092 S 2/2000 Lisseveld
6,041,763 A * 3/2000 Akyildiz ..... 123/538
6,143,045 A 11/2000 Witaszak et al.
6,361,689 B1 * 3/2002 Munzing ..... 210/222

* cited by examiner

FUEL TREATMENT DEVICE USING A MAGNETIC FIELD

BACKGROUND AND SUMMARY OF THE INVENTION

Refining methods employed in the late $20^{th}$ and early $21^{st}$ centuries produce hydrocarbon fuels and oils that are unstable. Such instability results in polymerization and agglomerations of organic compounds that reduce filterability and clean combustion of diesel fuels and gas-oil. In the case of hydrocarbon fuels, asphaltenes (precursors to heavy hydrocarbon oils) and resins have mechanical affinity for each other and thereby have a tendency to form flocculations or aggregations. As these clusters of large molecules increase in size, they clog fuel filters and can eventually contribute to sludge in fuel storage tanks.

Fuel treatment methods have worked from the premise that filterability problems with diesel fuel were largely due to "bio-fouling" (i.e. microbial activity from fungus, yeast, mold, and aerobic or anaerobic sulfur-reducing bacteria). Although microbial activity plays a role in the deterioration of fuel quality and may contribute to repolymerization, it is not the sole cause of fuel instability.

Magnetic fuel treatment has focused on passing fuel through a weak magnetic field (with flux density of 200 to 500 gauss) for the purpose of improving fuel filtration and alleviating the filter clogging believed to be caused by microbial contaminant build-up. Even though results have shown some improvement in fuel filterability, current methods have not been able to address the larger issues of fuel stability.

Magnetic field flux density varies depending on the magnetic material used, the shape of the magnet, the positioning of the poles, and proximity to the poles. At the atomic level, inductive forces are transmitted to a fluid passing through magnetic flux, producing an orientation effect on polar molecules in the fuel, and thus discourages clustering of paraffins and other long chain molecules, allowing them, as a consequence, to stay in suspension and thus bum more completely. The strength of this effect depends on the direction of fluid flow relative to flux lines, as well as velocity of flow and magnetic flux density. Research and field trials conducted by the inventor have shown that fuel channel design can be altered to optimize the orientation effect beyond that of current treatment devices, thereby producing unexpected improvements in fuel combustion and filterability.

The present invention, in certain aspects, is directed to a fuel treatment device comprising a housing, the housing further comprising an inner compartment, a fuel entry port, and a fuel exit port. The inner compartment includes a substantially circular side wall, a lower floor integral with the side wall, and a raised platform integral with the floor. The inner compartment further comprises a central post integral with and extending from the platform, with the post having a diameter smaller than the diameter of the platform. The central platform, in combination with the circular side wall and lower floor, form a substantially C-shaped groove in the housing. The device further includes a circular magnet housed within the inner compartment, the magnet comprising a central opening sufficiently sized to accommodate the central post. The magnet also includes upper and lower surfaces, an outer side surface defining the circumference of the magnet, and a thickness measured vertically from the lower surface to the upper surface along the outer side walls of the magnet, such that when the magnet is placed within the housing, the post is contained within the central opening of the magnet and the lower surface of the magnet is positioned upon the platform. The device also comprises a cover secured to the housing. The cover has an inner surface comprising a substantially C-shaped groove corresponding to the C-shaped groove of the inner compartment, such that the grooves of the cover and inner compartment, in combination with the outer side surface of the magnet, form a fuel channel through which fuel flows from the entry port and out of the exit port. The fuel channel has an area defined by a vertical cross-section taken through said housing. In this aspect of the invention, the maximum distance between the surfaces of the magnet (i.e. outer side surface and lower surface) and the side wall and lower floor of the inner compartment, respectively, is from about 17% to about 31% of the thickness of the magnet. Moreover, the maximum distance between the upper surface of the magnet and the inner groove of the cover is from about 17% to about 31% of the thickness of the magnet.

In another aspect of the present invention, the fuel treatment device comprises a housing as described above, with the fuel entry and exit ports oriented in registration with one another through opposite walls of the housing and in communication with the inner compartment. Here, the entry and exit ports each have a port area defined by the formula $\pi r^2$, wherein r is the radius of the two-dimensional circle defined by the ports. The inner compartment comprises a substantially circular side wall, a lower floor integral with the side wall, and a raised platform integral with the floor, the platform having a centrally positioned, substantially circular portion and an arm integral with and extending from the circular portion of the platform. The arm portion is also integral with a portion of the side wall and positioned between the entry and exit ports. The inner compartment further comprises a central post integral with and extending from the platform as described above, wherein the post has a diameter smaller than the platform diameter, and wherein the central platform, in combination with the circular side wall and lower floor of the inner compartment, form a substantially C-shaped groove in the housing. A circular magnet is housed within the inner compartment as described above such that the magnet completely covers the platform, thereby obstructing fuel flow directly between the entry and exit ports when fuel is introduced therein. The device further includes a cover secured to the housing, the cover configured as described above. The fuel channel formed by the respective grooves of cover and inner compartment in combination with the magnet has an area defined by a vertical cross-section taken through the housing. The fuel channel area: port area ratio in this embodiment ranges from about 0.65:1 to 2.5:1.

Other aspects of the present invention, either alone or combination with the features described above, include the inner compartment platform, the platform of the inner surface of the cover, and the magnet being dimensioned such that from about 17% to about 31% of the magnet's upper and/or lower surface is covered by the one or both platforms. Similarly, device is so dimensioned such that from about 50% to about 70%, preferably about 58%, of all of the magnet's surfaces are exposed to fuel flowing through the device. Such designs serve to concentrate fuel flow within the device to areas of greatest flux density for improved treatment thereof. Finally, in certain aspects of the present invention, fuel flow is concentrated within an area of greatest magnetic flux density, the flux density ranging from about 600 to about 1,200 Gauss.

DETAILED DESCRIPTION OF THE EMBODIMENTS OF THE INVENTION

The present invention is directed to a fuel treatment device, in particular a fuel treatment device that utilizes a magnetic field effective in improving combustion and filterability of conventional petroleum-based hydrocarbon fuels (i.e. fossil fuels).

Figure 1:
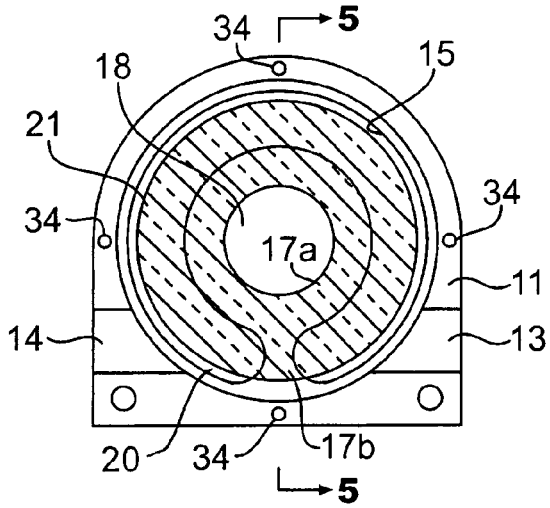
FIG. 1 is a top view of the housing of the device (without cover) showing the magnet contained therein.
Figure 2:
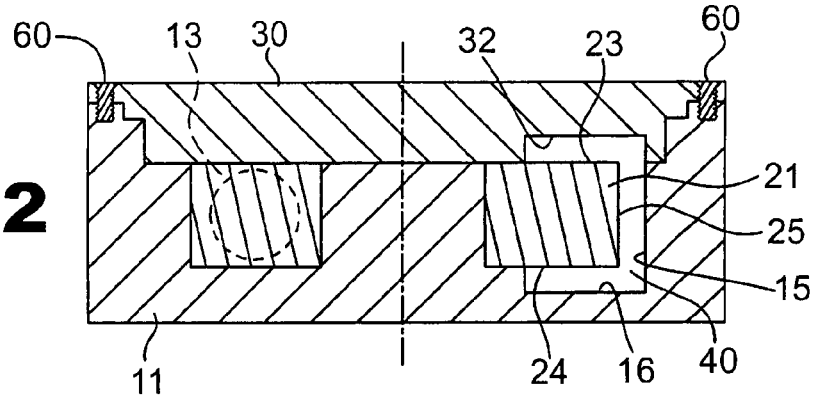
FIG. 2 is a side sectional view of the housing illustrated in FIG. 10, with a portion of the magnet cut away to show the fuel entry port.

Referring now to the figures, the invention in certain aspects comprises a fuel treatment device 10 comprising a housing 11, the housing further having an inner compartment 12. The housing 11 also has a fuel entry port 13 and a fuel exit port 14, which in the embodiments illustrated in the figures, are in registration with one another. When the device is installed within a fuel line, the fuel line is split so that it may be connected to the fuel entry and exit ports. FIG. 1 illustrates the fuel entry port 13, for example, as being positioned on the right side of the housing; however, it will be appreciated by the skilled artisan that these fuel ports may be reversed (i.e. the entry port may be where the exit port 14 is shown). FIG. 2 shows the entry port 13, which has circular configuration. The area of the port is defined by $\pi r^2$, wherein "r" is the radius of the two-dimensional circle of the port formed in cross section (see FIG. 4, for example).

The inner compartment 12 within the device housing has a substantially circular side wall 15 when viewed from the top (FIG. 1). The inner compartment further includes a lower floor 16, and in a preferred embodiment, a central platform 17 integral therewith. In the embodiments shown herein, the platform has a circular portion 17*b* and an arm portion 17*a* integral with and extending therefrom. The arm portion is also integral with a portion of the side wall 15 of the inner compartment and positioned between the fuel entry and exit ports 13, 14, as shown in FIGS. 1–4, for example. Extending from the central platform is a post 18 having a diameter $D_1$ smaller than the diameter $D_2$ of the platform. As shown in the figures, the combination of the platform 17, side wall 15, and lower floor 16 form a substantially C-shaped groove 20 in the housing, as best illustrated in FIG. 1.

Figure 10:
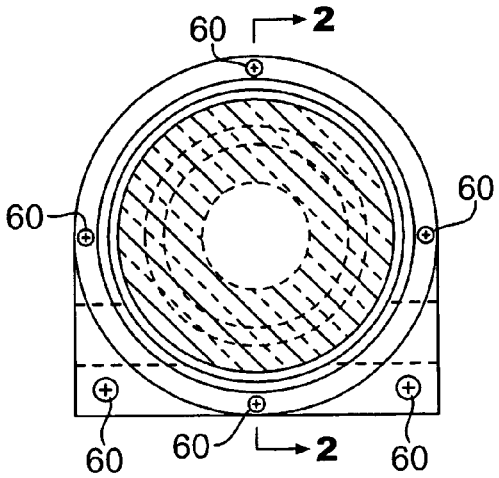
FIG. 10 is a top view of the device with the cover secured thereto, with the magnet and a portion of the inner compartment shown in phantom.
Figure 11:
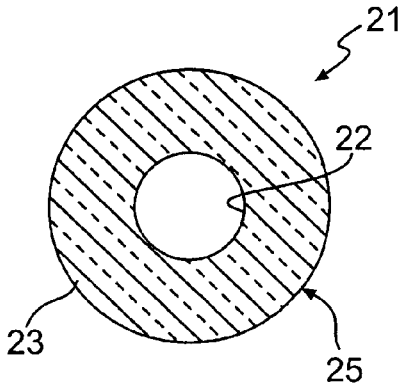
FIG. 11 is a top view of the magnet.

The device includes a circular magnet 21 (e.g. a ceramic 8 type magnet) housed within the inner compartment (in FIGS. 1 and 10, the magnet is shown in phantom). The magnet has a central opening 22 sufficiently sized to accommodate the central post 18 of the housing. The magnet includes upper 23 and lower 24 surfaces as well as an outer surface 25 defining the circumference of the magnet when viewed from above (see FIG. 11). When the magnet is placed within the inner compartment of the housing, with the post 18 engaged within the central opening 22, the lower surface of the magnet is positioned upon the platform 17 to completely cover the platform, thereby obstructing fuel flow directly between the entry and exit ports.

Figure 3:
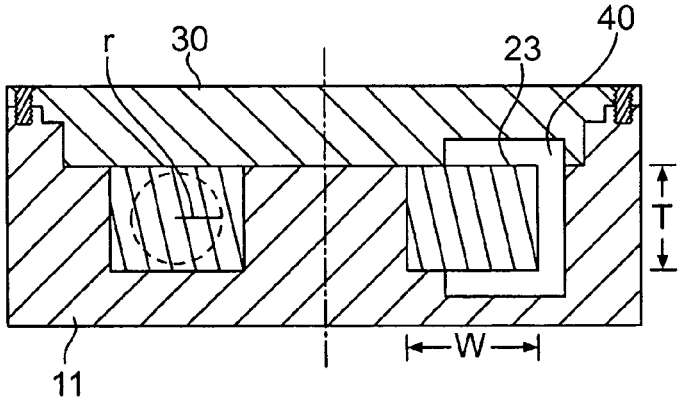
FIG. 3 is side view identical to that shown in FIG. 2, but referencing additional features of the device.
Figure 4:
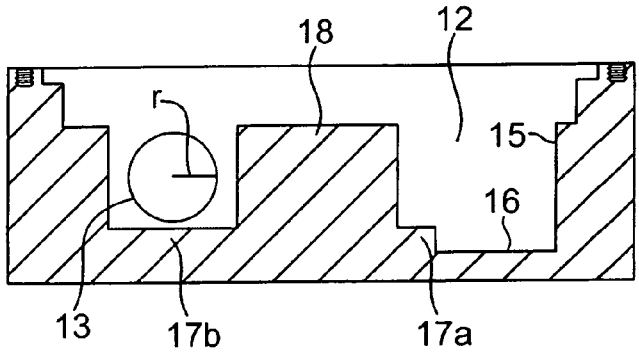
FIG. 4 is a side sectional view of the housing illustrated in FIG. 1, but without the magnet.
Figure 5:
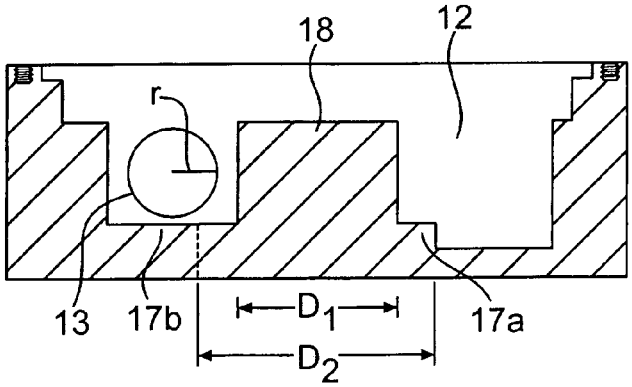
FIG. 5 is a side sectional view identical to that shown in FIG. 4, but referencing additional features of the device.
Figure 7:
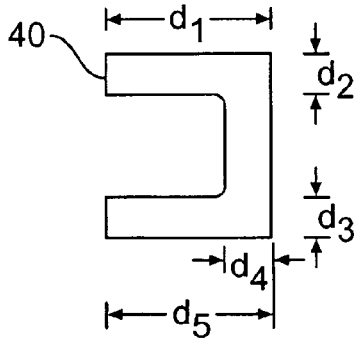
FIG. 7 is a sectional view identical to that shown in FIG. 6, but referencing additional features of the device.
Figure 8:
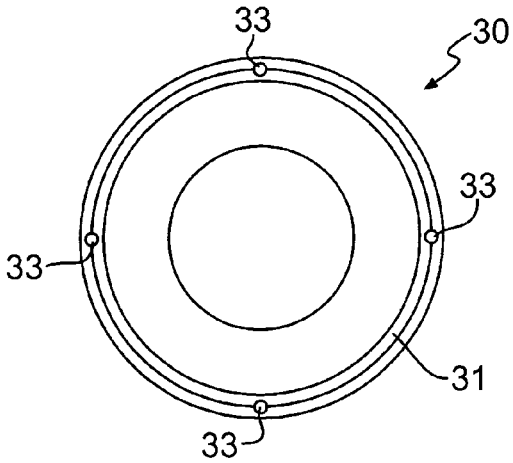
FIG. 8 is a top view of the cover.
Figure 9:
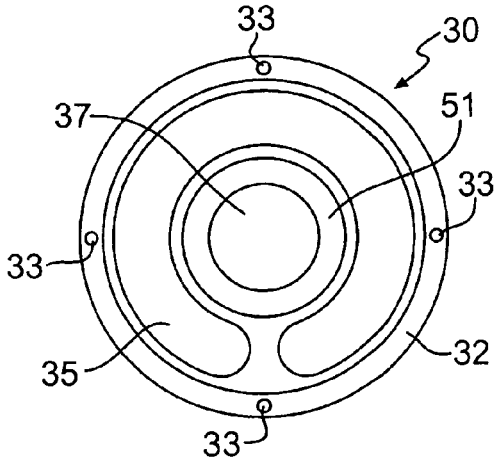
FIG. 9 is a bottom view of the cover illustrated in FIG. 8, showing the inner surface of the cover.

The device also includes a cover 30 having a top surface 31 (FIG. 8) and an inner surface 32 (FIG. 9). The cover may be removably secured to the housing by any conventional fastening means, including, but not limited to, screws, bolts, pins, and the like. If screws 60, for example, are used to fasten the cover to the housing, a series of bores 33 are provided on the cover and a complementary series of threaded bores 34 are provided through the upper surface of the housing (FIG. 1), in registration with the cover bores 33, to engage the screws. As most clearly illustrated in FIG. 9, the inner surface 32 of the cover has a substantially C-shaped groove 35 corresponding to the C-shaped groove 20 of inner compartment of the housing, such that the grooves 20, 35, in combination with the surfaces of the magnet, form a fuel channel 40, as shown in FIGS. 2–4. The fuel channel (shown in hatched lines in FIGS. 6–7) has an area defined by a two-dimensional vertical cross-section taken through the housing.

O-rings may be used to form a seal between the cover and housing in order to prevent fuel leakage from the housing. In FIG. 9, elastomeric O-rings may be placed in circular grooved areas 50, 51.

In previous devices known in the art, the fuel treatment area (i.e. fuel channel area) had been in the order of 3.5 times larger than the engine's fuel line area (i.e. fuel entry port area). That is, the fuel channel area: fuel line (i.e. fuel entry port) area ratio is around 3.5:1 in some current magnetic fuel treatment devices. In one aspect of the present invention, the fuel channel area is reduced, thereby resulting in an improvement in filterability of the fuel. Thus, a preferred fuel channel to port area ratio is from about 0.65:1 to 2.5:1.

Figure 6:
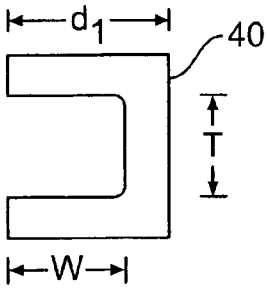
FIG. 6 is a sectional view of the fuel channel (hatched lines) illustrated in FIG. 2.

It has further been discovered by the inventor that inducing turbulence in the fluid flow further enhances the combustibility of magnetically treated fuel. Prior devices in the art have aimed to maintain laminar flow of fluid through the device; however, in the present invention, a narrower fuel channel (i.e. a channel width: exposed magnet width w ratio of less than 2.5:1, more preferably about 1.4:1 or less) (FIGS. 3 and 6).

Similarly, in previous devices, the maximum distance between the outer surface of magnet and the sides of the fuel treatment channel is from 75% to 300% of the magnet's thickness. In one aspect of the present invention, the range for the maximum distance between the magnet's outer surface and the wall of the fuel channel (designed $d_2$, $d_3$, and $d_4$ in FIGS. 6–7 for ease of illustration) is from about 17% to about 30% of the magnet's thickness T. In particular, when this feature is combined with the reduced fuel channel area:fuel entry port area, such that a fuel within the device is concentrated or focused within the area of greatest magnetic flux density (i.e. about 600 to about 1,200 Gauss), with the unexpected result that the asphaltenes and waxes within the fuel (i.e. organic hydrocarbon compounds in crude oil and refined diesel and fuel-oil) are thereby affected to prevent their aggregation downstream. The inventor has discovered that such compounds are indeed only affected or influenced by magnetic fields stronger than the 200–500 Gauss range found in current magnetic fuel treatment devices. Consequently, the design of the inventive fuel treatment device provides a stronger magnetic field for fuel treatment, thereby improving combustibility of the treated fuel.

Aspects of the present invention further include a fuel treatment device having a central platform, post, and magnet disposed upon the platform and post as described above; however, the magnet and platform are dimensioned such that about 50% to about 75%, preferably about 68%, of the lower surface of the magnet is covered by the platform. Similarly, the inner surface of the cover, which comprises a C-shaped groove described above that is defined in part by a centrally positioned raised platform 34, is sufficiently sized with respect to the magnet such that about 50% to 75%, preferably about 68%, of the magnet's upper surface is covered by the cover platform 34, thereby concentrating fuel flow within the device to areas of greatest flux density. Prior embodiments shield only about 19% of the magnet's outer surfaces. In combination, from about 50% to about 70%, more preferably about 58%, of the magnet's entire upper, lower, and outer surfaces are exposed to fuel flowing through the device (compared to up to about 87% average total exposure), thereby concentrating the fuel flow within the device to areas of greatest flux density for the benefits described herein.

Figure 12:
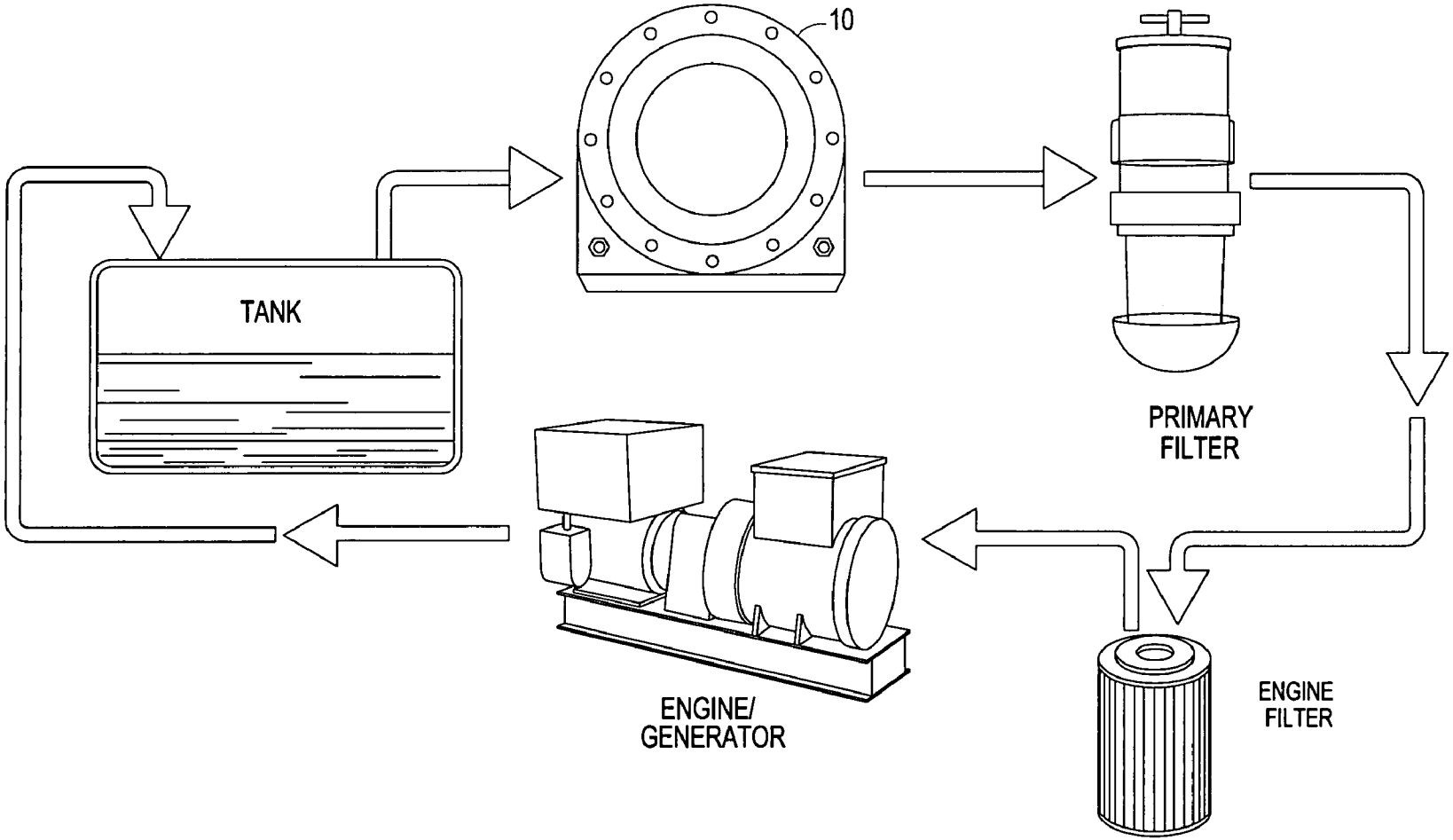
FIG. 12 is a flow chart of an exemplary engine system employing the inventive fuel treatment device.

The present invention may be used to treat fuel for use in a variety of applications. The invention may be installed in a motorized vehicle or other system powered by a fuel-operated engine generator. Preferably, the inventive fuel treatment device is installed between the fuel tank and primary filter assembly (FIG. 12). Fuel flows through the fuel entry port, through the fuel channel, and exits the exit port. While in the channel, the fuel is subjected to the magnetic field at a given velocity (e.g. 1–15 ft/sec, preferably 1–6 ft./sec) and dwell time (e.g. 0.1 to 1 second), depending upon the size of the fuel treatment device.

It will be appreciated by those of ordinary skill in the art that the dimensions of the inventive treatment device may be varied, with larger housings, for example, being employed for larger fuel engine systems, although various preferred ratios and percentages described herein remain the same. In a preferred commercial embodiment, the dimensions of the fuel channel, in the cross-section shown in FIGS. 6–7, 0.500 in ($d_1$)×0.265 in ($d_2$)×0.250 in. ($d_3$)×0.245 in. ($d_4$)×0.500 in. ($d_5$). A preferred size of magnet is 3.38 in (total diameter) ×1.280 in (ring width)×0.85 in (ring thickness or height), with a total surface area of 24.3 square inches.

The foregoing disclosure and description of the invention are illustrative and explanatory thereof, and various changes with respect to the size, shape, and materials, as well as in the details of the illustrated construction may be made without departing from the spirit of the invention, and therefore fall within the scope of the appended claims even though such variations were not specifically discussed above.

I claim:

1. A fuel treatment device comprising:

a. a housing, said housing further comprising an inner compartment, a fuel entry port, and a fuel exit port, said entry and exit ports oriented in registration with one another through opposite walls of said housing and in communication with said inner compartment, said entry and exit ports each having a port area defined by the formula $\pi r^2$;

b. said inner compartment comprising a substantially circular side wall, a lower floor integral with said side wall, and a raised platform integral with said floor, said platform having a centrally positioned, substantially circular portion and an arm integral with and extending from said circular portion of said platform, said arm integral with a portion of said side wall and positioned between said entry and exit ports;

c. said inner compartment further comprising a central post integral with and extending from said platform, said platform having a diameter and said post having a diameter smaller than said platform diameter, and wherein said central platform, in combination with said circular side wall and lower floor, form a substantially C-shaped groove in said housing;

d. a circular magnet housed within said inner compartment, said magnet comprising a central opening sufficiently sized to accommodate said central post, upper and lower surfaces, and an outer side surface defining the circumference of said magnet, such that when said magnet is placed within said housing, said post is contained within said central opening of said magnet and said lower surface of said magnet is positioned upon said platform to completely cover said platform, thereby obstructing fuel flow directly between said entry and exit ports when fuel is introduced therein;

e. a cover secured to said housing, said cover having an inner surface comprising a substantially C-shaped groove corresponding to said C-shaped groove of said inner compartment, such that said C-shaped grooves of said cover and inner compartment, in combination with said surfaces of said magnet, form a fuel channel through which fuel flows from said entry port and out of said exit port, said fuel channel having an area defined by a vertical cross-section taken through said device; and f. a fuel channel area:port area ratio ranging from about 0.65:1 to about 2.5:1.

2. The fuel treatment device of claim 1, wherein a maximum distance between said outer side surface of said magnet and said side wall of said inner compartment is from about 17% to about 31% of said thickness of said magnet, and a maximum distance between said lower surface of said magnet and said lower floor of said inner compartment, is from about 17% to about 31% of said thickness of said magnet, and wherein a maximum distance between said upper surface of said magnet and said inner groove of said cover is about 17% to about 31% of said thickness of said magnet.

3. The fuel treatment device of claim 2, wherein said magnet is positioned within said inner compartment such that said lower platform covers about 68% of said lower surface of said magnet and said cover platform covers about 68% of said upper surface of said magnet, thereby concentrating fuel flow within said device to areas of greatest flux density.

4. The fuel treatment device of claim 3, wherein from about 50% to about 70% of said magnet surfaces, in combination, are exposed to said fuel flowing through said device.

5. The fuel treatment device of claim 4, wherein about 58% of said magnet surfaces, in combination, are exposed to said fuel flowing through said device.

6. A fuel treatment device comprising:

a. a housing, said housing further comprising an inner compartment, a fuel entry port, and a fuel exit port;

b. said inner compartment comprising a substantially circular side wall, a lower floor integral with said side wall, and a raised platform integral with said floor;

c. said inner compartment further comprising a central post integral with and extending from said platform, said platform having a diameter and said post having a diameter smaller than said platform diameter, and wherein said central platform, in combination with said circular side wall and lower floor, form a substantially C-shaped groove in said housing;

d. a circular magnet housed within said inner compartment, said magnet comprising a central opening sufficiently sized to accommodate said central post, upper and lower surfaces, an outer side surface defining the circumference of said magnet, and a thickness measured vertically from said lower surface to said upper surface along said outer side walls of said magnet, such that when said magnet is placed within said housing, said post is contained within said central opening of said magnet and said lower surface of said magnet is positioned upon said platform; and e. a cover secured to said housing, said cover having an inner surface comprising a substantially C-shaped groove corresponding to said C-shaped groove of said inner compartment, such that said C-shaped grooves of said cover and inner compartment, in combination with said outer side surface of said magnet, form a fuel channel through which fuel flows from said entry port and out of said exit port, said fuel channel having an area defined by a vertical cross-section taken through said housing; and wherein a maximum distance between said outer side surface and said lower surface of said magnet and said side wall and lower floor of said inner compartment is from about 17% to about 31% of said thickness of said magnet and wherein a maximum distance between said upper surface of said magnet and said inner groove of said cover is about 17% to about 31% of said thickness of said magnet.

7. The fuel treatment device of claim 6, wherein said fuel flow within said device is concentrated within an area of greatest magnetic flux density, said flux density ranging from about 600 to about 1,200 Gauss.

8. The fuel treatment device of claim 6, wherein said magnet is positioned within said inner compartment such that said lower platform covers about 68% of said lower surface of said magnet and said cover platform covers about 68% of said upper surface of said magnet, thereby concentrating fuel flow within said device to areas of greatest flux density.

9. The fuel treatment device of claim 8, wherein from about 50% to about 70% of said magnet surfaces, in combination, are exposed to said fuel flowing through said device.

10. The fuel treatment device of claim 9, wherein about 58% of said magnet surfaces, in combination, are exposed to said fuel flowing through said device.

11. The fuel treatment device of claim 8, wherein said fuel flow within said device is concentrated within an area of greatest magnetic flux density, said flux density ranging from about 600 to about 1,200 Gauss.

12. The fuel treatment device of claim 11, wherein from about 50% to about 70% of said magnet surfaces, in combination, are exposed to said fuel flowing through said device.

13. The fuel treatment device of claim 12, wherein about 58% of said magnet surfaces, in combination, are exposed to said fuel flowing through said device.

14. A fuel treatment device comprising:

a. a housing, said housing further comprising an inner compartment, a fuel entry port, and a fuel exit port;

b. said inner compartment comprising a substantially circular side wall, a lower floor integral with said side wall, and a raised platform integral with said floor;

c. said inner compartment further comprising a central post integral with and extending from said platform, said platform having a diameter and said post having a diameter smaller than said platform diameter, and wherein said central platform, in combination with said circular side wall and lower floor, form a substantially C-shaped groove in said housing;

d. a circular magnet housed within said inner compartment, said magnet comprising a central opening sufficiently sized to accommodate said central post, upper and lower surfaces, and an outer side surface defining the circumference of said magnet, such that when said magnet is placed within said housing, said post is contained within said central opening of said magnet and said lower surface of said magnet is positioned upon said platform to completely cover said platform; and e. a cover secured to said housing, said cover having an inner surface comprising a substantially C-shaped groove defined in part by a centrally positioned, raised platform, said cover groove corresponding to said C-shaped groove of said inner compartment, such that said C-shaped grooves of said cover and inner compartment, in combination with said outer side surface of said magnet, form a fuel channel through which fuel flows from said entry port and out of said exit port, said fuel channel having an area defined by a vertical cross-section taken through said housing; and wherein said magnet is positioned within said inner compartment such that said lower platform covers about 68% of said lower surface of said magnet and said cover platform covers about 68% of said upper surface of said magnet, thereby concentrating fuel flow within said device to areas of greatest flux density.

15. The fuel treatment device of claim 14, wherein from about 50% to about 70% of said magnet surfaces, in combination, are exposed to said fuel flowing through said device.

16. The fuel treatment device of claim 15, wherein about 58% of said magnet surfaces, in combination, are exposed to said fuel flowing through said device.

17. The fuel treatment device of claim 14, wherein said fuel flow within said device is concentrated within an area of greatest magnetic flux density, said flux density ranging from about 600 to about 1,200 Gauss.

18. A fuel treatment device comprising:

a. a housing, said housing further comprising an inner compartment, a fuel entry port, and a fuel exit port;

b. said inner compartment comprising a substantially circular side wall, a lower floor integral with said side wall, and a raised platform integral with said floor;

c. said inner compartment further comprising a central post integral with and extending from said platform, said platform having a diameter and said post having a diameter smaller than said platform diameter, and wherein said central platform, in combination with said circular side wall and lower floor, form a substantially C-shaped groove in said housing;

d. a circular magnet housed within said inner compartment, said magnet comprising a central opening sufficiently sized to accommodate said central post, upper and lower surfaces, and an outer side surface defining the circumference of said magnet, such that when said magnet is placed within said housing, said post is contained within said central opening of said magnet and said lower surface of said magnet is positioned upon said platform, thereby creating an exposed lower magnet surface having a width measured from said platforms to said outer side surface of said magnet;

e. a cover secured to said housing, said cover having an inner surface comprising a substantially C-shaped groove corresponding to said C-shaped groove of said inner compartment, such that said C-shaped grooves of said cover and inner compartment, in combination with said outer side surface of said magnet, form a fuel channel through which fuel flows from said entry port and out of said exit port, said fuel channel having a width measured from said platform to said outer surface of said inner compartment; and f. a fuel channel width:exposed magnet surface width of less than about 2.5:1.

19. The fuel treatment device of claim 18, wherein said fuel flow within said device is concentrated within an area of greatest magnetic flux density, said flux density ranging from about 600 to about 1,200 Gauss.

20. The fuel treatment device of claim 18, wherein said fuel channel width:exposed magnet surface width is about 1.4:1 or less.

21. The fuel treatment device of claim 20, wherein said fuel flow within said device is concentrated within an area of greatest magnetic flux density, said flux density ranging from about 600 to about 1,200 Gauss.

* * * * *